US005082396A

United States Patent [19]

Polacek

[11] Patent Number: 5,082,396

[45] Date of Patent: Jan. 21, 1992

[54] VIBRATORY ROLLER

[75] Inventor: Manfred Polacek, Munich, Fed. Rep. of Germany

[73] Assignee: Wacker Corporation, Menomonee Falls, Wis.

[21] Appl. No.: 602,669

[22] Filed: Oct. 24, 1990

[30] Foreign Application Priority Data

Dec. 8, 1989 [DE] Fed. Rep. of Germany ..... 3940653

[51] Int. Cl.[5] ..... E01C 19/38; E01C 19/26

[52] U.S. Cl. ..... 404/117; 404/127; 404/102

[58] Field of Search ..... 404/117, 127, 102–103, 404/116; 280/788, 688

[56] References Cited

U.S. PATENT DOCUMENTS

| | | | |
|---|---|---|---|
| 2,750,751 | 6/1956 | Harrison | 404/127 |
| 3,153,993 | 10/1964 | Keppler | 404/117 |
| 3,383,992 | 5/1968 | Kaltenegger | 404/127 |
| 3,395,626 | 8/1968 | Garis et al. | 404/117 |
| 3,605,583 | 9/1971 | Keppler | 404/117 |
| 3,778,177 | 12/1973 | Haker et al. | 404/117 |
| 3,814,531 | 6/1974 | Carnahan et al. | 404/117 |
| 4,145,156 | 3/1979 | Grane | 404/117 X |
| 4,176,983 | 12/1979 | Gardner | 404/117 |
| 4,187,036 | 2/1980 | Haker et al. | 404/117 |
| 4,350,460 | 9/1982 | Schmelzer et al. | 404/117 |
| 4,454,780 | 6/1984 | Gohler et al. | 404/117 |
| 4,913,581 | 4/1990 | Weiler | 404/117 |
| 4,927,289 | 5/1990 | Artzberger | 404/127 X |

FOREIGN PATENT DOCUMENTS 3902316 12/1989 Fed. Rep. of Germany .

*Primary Examiner*—Ramon S. Britts
*Assistant Examiner*—Nancy P. Connolly
*Attorney, Agent, or Firm*—Nilles & Nilles

[57] ABSTRACT

A vibratory roller is disclosed having a frame comprised of pivotally interconnected front and rear subframes. A motor is mounted on the frame and a steering mechanism is provided to articulate the subframe relative to each other. A roller drum carrier is mounted by a longitudinal centerline suspension system to support each of the subframes. Ground engaging roller drums are rotatably mounted on the roller drum carrier for rotation about an axle axis. An exciter mechanism for generating a vibratory compacting force is mounted in the roller drum carrier below the axis. Hydraulic drive units for rotating the roller drums are mounted in the roller drive carrier above the axis.

17 Claims, 4 Drawing Sheets

VIBRATORY ROLLER

BACKGROUND OF THE INVENTION

1. Field of the Invention

The present invention relates to a vibratory roller and more specifically to a vibratory roller of the type that is adapted for use to compact base material in narrow spaces such as at the bottom of trenches.

2. Description of the Related Art

Many different types of vibratory rollers have been designed for use in compacting base and subbase materials in trenches, foundations, utility excavations, roads and the like. Applicant is aware of the following prior patents showing vibratory rollers: U.S. Pat. No. 3,153,993, J. E. Keppler, issued Oct. 27, 1964; U.S. Pat. No. 3,395,626, G. D. Garis et al, Aug. 6, 1968; U.S. Pat. No. 3,605,583, J. E. Keppler, Sept. 20, 1971; U.S. Pat. No. 3,778,177, E. J. Haker, Dec. 11, 1973; U.S. Pat. No. 3,814,531, J. T. Carnahan et al, June 4, 1974; U.S. Pat. No. 4,187,034, E. J. Haker et al, Feb. 5, 1980; and DE 39 20 316 Al Offenlegungsschrift, Dec. 28, 1989.

All of the above cited prior patents disclose vibratory rollers that include some type of frame structure which may compose a single frame or interconnected front and rear subframes; rollers, or a combination of rollers and support wheels; a suspension means for mounting the roller on the frame structure; a steering means; a prime mover of some type which may include a hydraulic drive for driving the wheels or rollers to move the vibratory roller over the ground; and an exciter means for generating a vibration force. The exciter means includes heavy eccentric weights that are rotated to produce vertical forces which are transmitted to the rollers to compact the base material under the roller during operation. The exciter means is mounted on the upper portion of the frame, or concentrically on the axle of the roller either externally or internally of the roller.

There exists a long-standing practice by contractors to dig trenches having as narrow a width as possible to reduce the amount of material excavated and subsequently backfilled thus lowering costs. Trenches narrower than 24 inches are common. Various types of utilities are frequently installed in such trenches and settling of the base material in the bottom of the trench can result in damage or destruction of whatever type of installation has been placed in the trench. If fluid carrying pipes are installed, settlement could cause breakage and result in pollution of soil and ground water. Therefore, laws and regulations have become increasingly strict in requiring that the base material in the bottom of the trench be compacted. In narrow trenches such compacting is usually done with small hand operated compactors and this is very time-consuming and dangerous to the operator. Remote controlled, self-propelled vibratory rollers are known but those designed to be narrow enough in width to be lowered into narrow trenches, even those less than 24 inches wide, have not been entirely satisfactory.

In the prior art, design requirements for vibratory rollers are well defined. It has long been known that one requirement for a vibratory roller is that it should have lateral stability to minimize the risk of tipping. To meet this requirement the vibratory rollers are normally made quite wide and lateral stability is thus assured. When the vibratory roller is to be usable in a trench, a known second requirement must be met. The second requirement is that the vibratory roller must compact all of the base material in the trench including areas up to the side wall of the trench. To meet this requirement, the vibratory roller is designed so that no components will extend laterally beyond the width of the roller drum which is in compacting contact with the base material. To eliminate lateral projections, all components are arranged vertically on top of the roller drums and the lateral stability requirement, as mentioned above, is met by making the roller drums as wide as possible. As trenches have become narrower, the lateral stability requirement cannot be met by making the roller drum wider. The problem of how to lower the overall center of gravity of the vibratory roller to maximize lateral stability remains unsolved, and conventional heretofore-used designs do not offer any effective solutions to this problem of maximizing the lateral stability. Conventional vertical arrangements of components, and suspension systems for mounting the roller drums on the frame only tend to raise the overall center of gravity of a narrow vibratory roller.

Therefore, what is needed is a new and improved design and orientation of the vibratory roller components to maximize the effect of their weight in lowering the overall center of gravity of the vibratory roller to enhance lateral stability. In addition, an improved suspension system is needed to maximize the concentration of the load forces of all of the components in a manner that will operate to further contribute to the lateral stability of a narrow vibratory roller.

SUMMARY OF THE INVENTION

The present invention includes a novel roller drive carrier and places the heavy weight of the exciter means within this roller drive carrier below the axle axis of the roller drum mounted thereon. Further, the drive motor units for the roller drum are also mounted within the roller drive carrier. In accord with a further aspect of the invention, a novel suspension means is provided for mounting the roller drum carrier to concentrate the load forces of all components not within the roller drum carrier on the centerline of the vibratory roller.

More specifically, the vibratory roller has a frame means. A roller drum carrier is mounted on the frame and includes an axle axis and an exciter support. The exciter support is located below the axle axis of the roller drum carrier when the vibratory roller is in a normal operating position. A roller drum means is mounted on the roller drive support means for rotation about the axle axis. A prime mover means is mounted on the frame means to rotate said roller drum means to move the vibrator roller. An exciter means having a stationary center of mass is mounted on the exciter support to place the center of mass below the axle axis to cause the center of gravity of the roller vibrator to be as close as possible to said base material when in a normal operating position.

Preferably the roller drum carrier includes a tubular housing having a peripheral wall. The tubular housing has a center portion, outboard ends, an interior lower space below the axle axis and an interior upper space above the axle axis with the exciter support being located in the lower space below the axle axis and motor drive units in the upper space above the axle axis.

In the preferred embodiment, the vibratory roller main frame comprises a front subframe and a rear subframe connected together by a center pivot means for articulation relative to each other. The steering means is mounted to cause the subframes to articulate relative to each other to a selectable degree in order to steer the roller vibrator. The roller drum carrier comprises individual front and rear roller drum carriers of identical construction mounted on the front and rear subframes, respectively, by the suspension means. The roller drum means is mounted on each of the roller drive carriers. The exciter means is mounted in at least one, and preferably both, of the roller drum carriers.

In another aspect of the invention the suspension means for mounting the roller drum carriers on the frame means includes outer and inner center mounts located on a center portion of the tubular housing. The outer and inner mounts lie in the centerline vertical plane of the frame means and extend transversely of the tubular housing toward the front and rear ends of the frame means. The outer center mount includes a single mounting connection to the front end of the frame means and the inner center mount includes two vertically spaced apart mounting connections to the frame means. Preferably the mounting connections include front and rear U-shaped yokes lying in the centerline vertical plane for connection with the outer and inner center mounts, respectively.

BRIEF DESCRIPTION OF THE DRAWINGS

Referring to the drawings.

Figure 1:
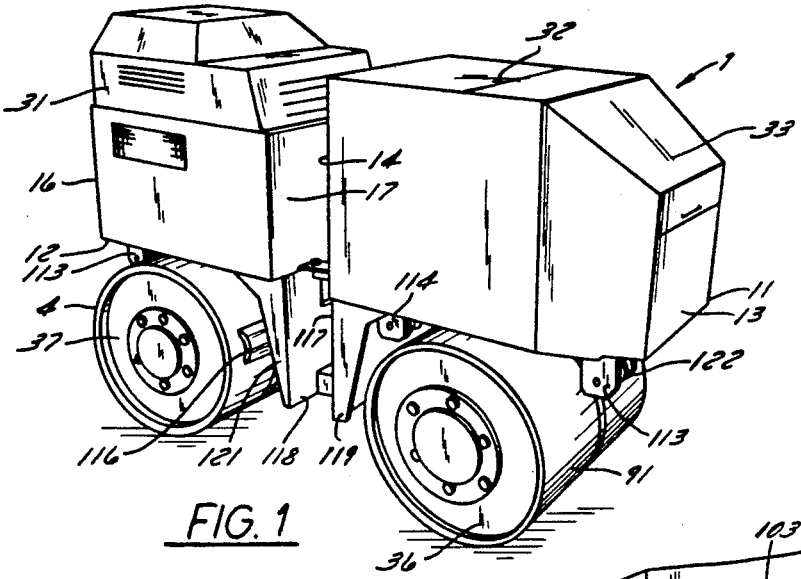
FIG. 1 is an isometric view projection view of the vibratory roller incorporating the invention of the present application.
Figure 9:
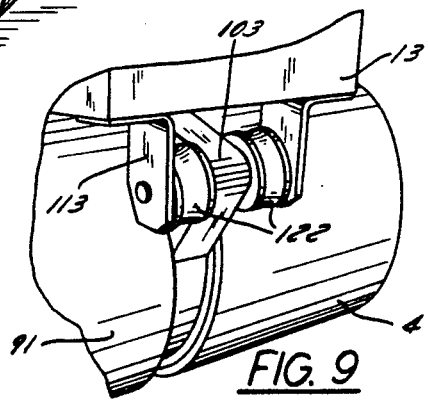
Figure 2:
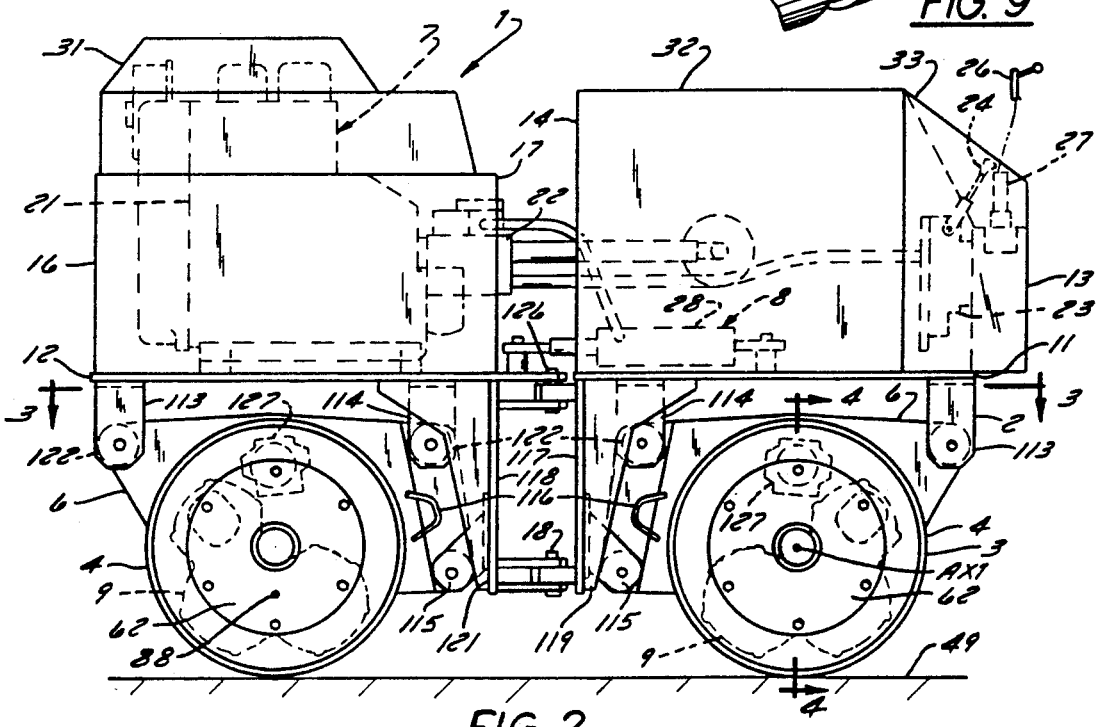
FIG. 2 is a side elevational view of the vibratory roller shown in FIG. 1.
Figure 6:
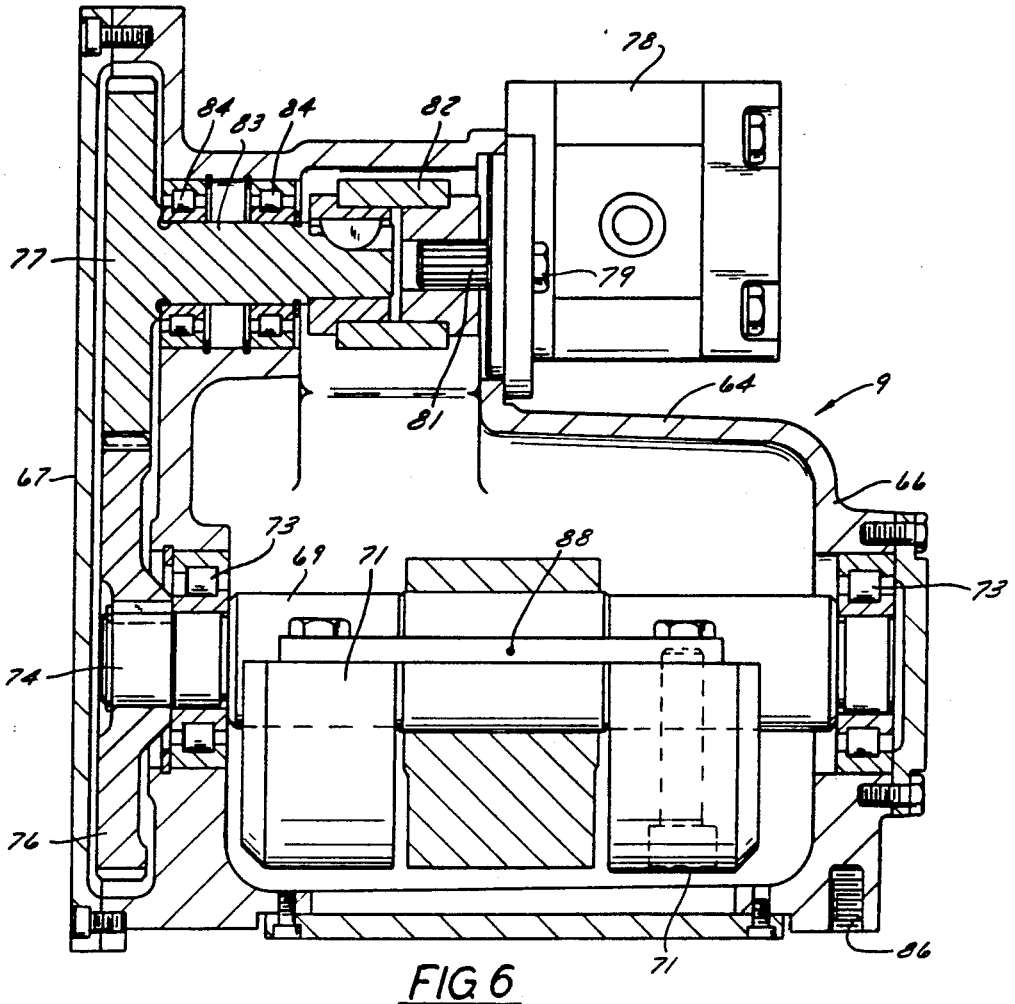
Figure 3:
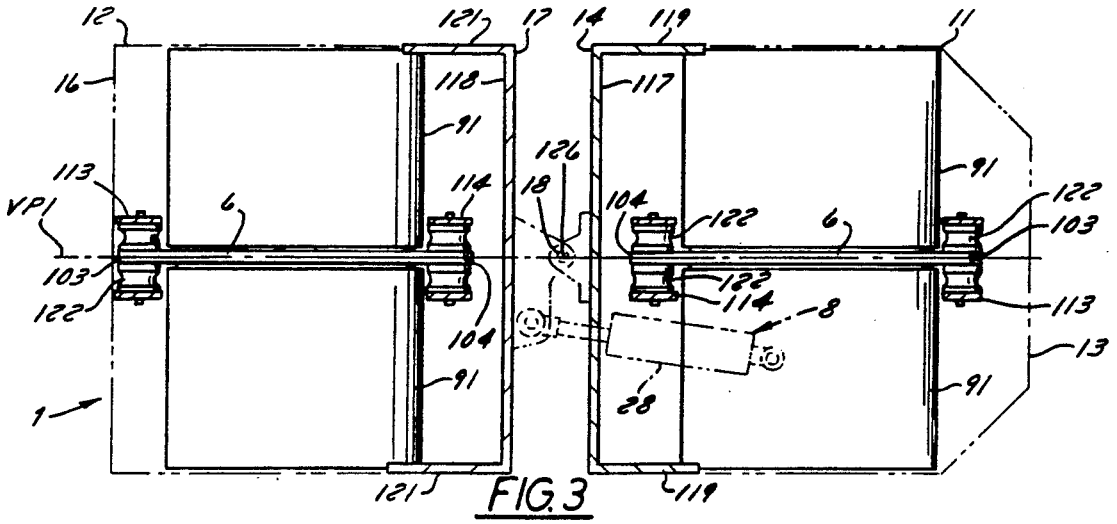
Figure 4:
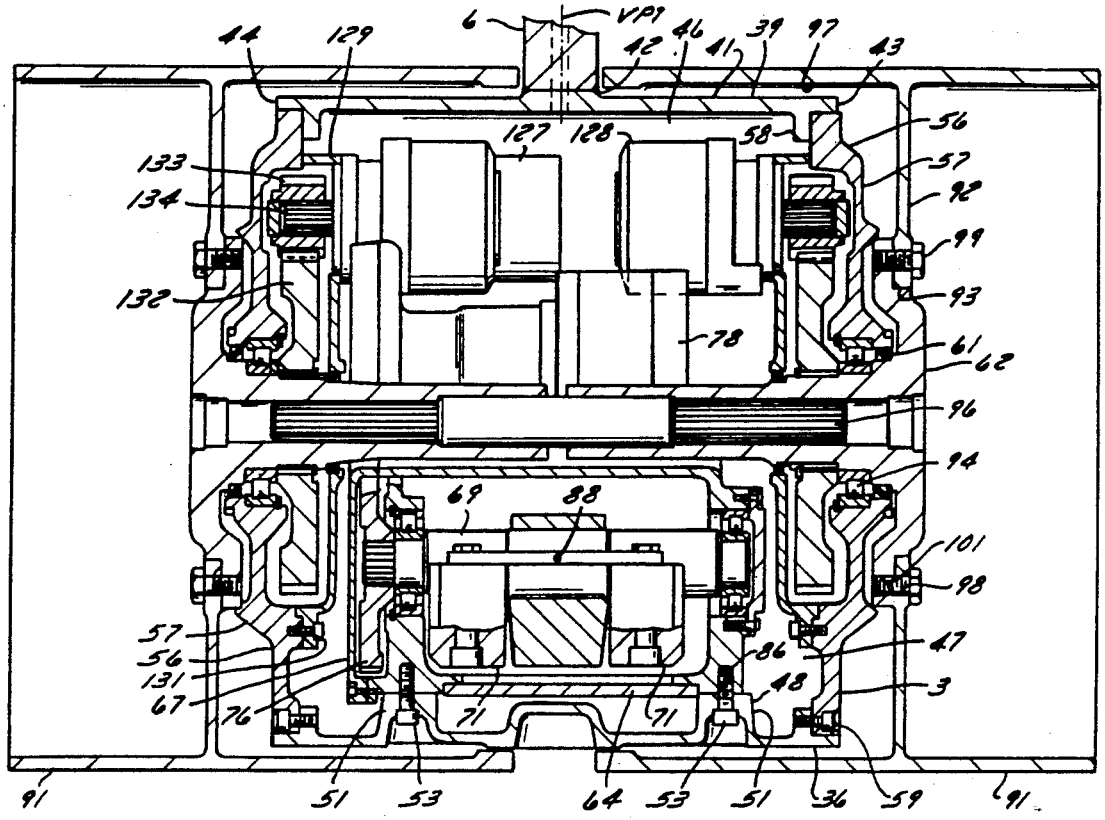
Figure 5:
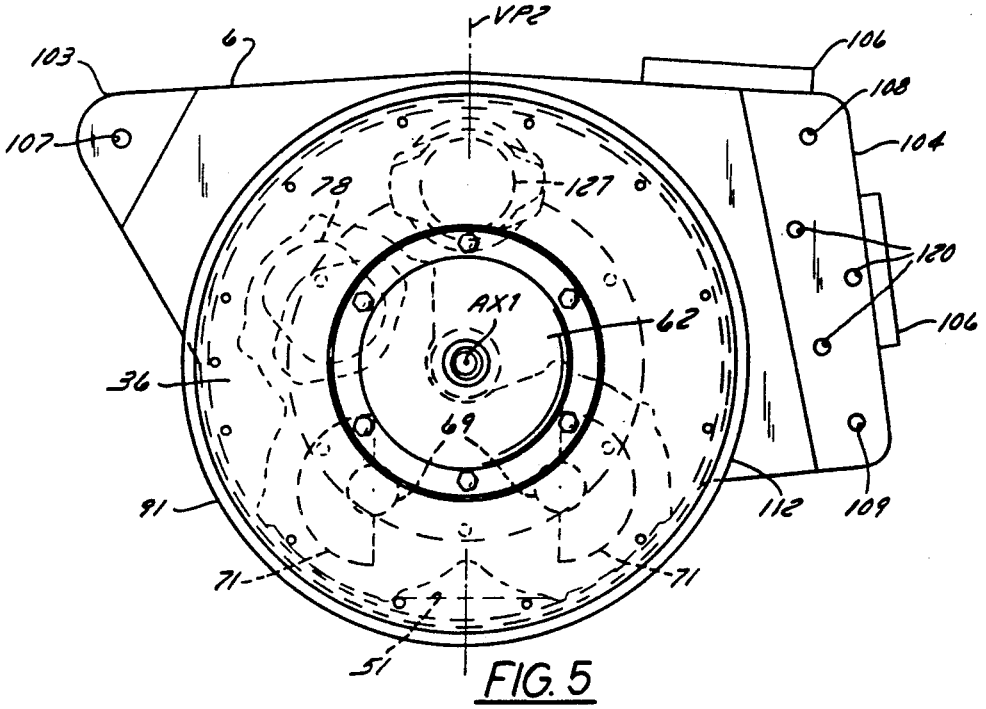
Figures 7, 8:
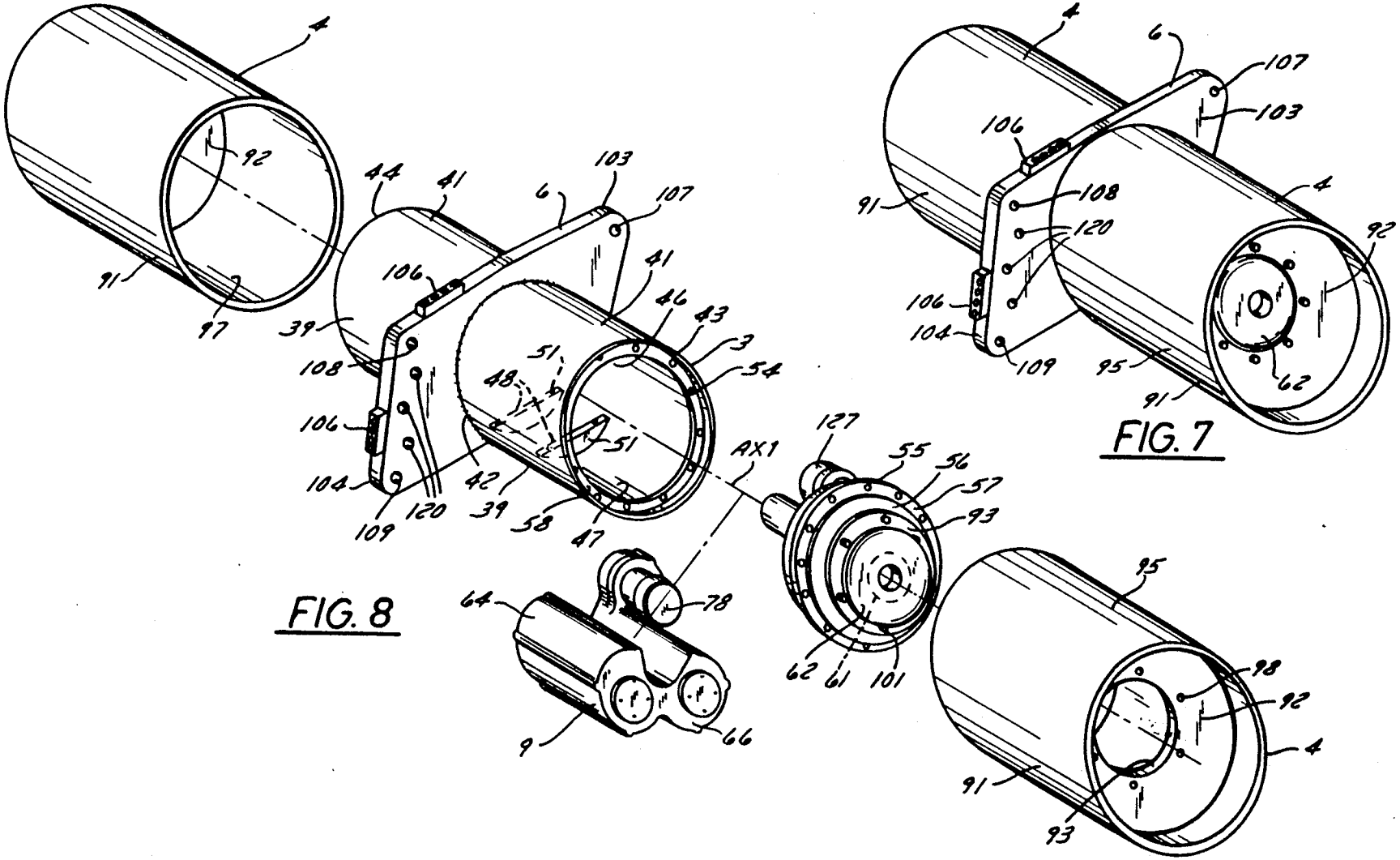

is a cross-sectional view taken along line 3—3 of FIG. 3 showing the overlying components of the vibratory roller above the section line in phantom;

FIG. 4 is a cross sectional view taken along line 4—4 of FIG. 2 showing the roller drum carrier and its associated roller drum drive means and exciter mechanism;

FIG. 5 is an end view of the roller drum carrier shown in FIG. 4;

FIG. 6 is an enlarged side view of the exciter mechanism shown in FIG. 4 partially in section;

FIG. 7 is an isometric projection view of the roller drum carrier and its suspension means;

FIG. 8 is an exploded view of the roller drum carrier and suspension means shown in FIG. 7; and FIG. 9 is a perspective view of the front portion of the roller drum assembly shown in FIG. 7 attached to the front of the vibratory roller shown in FIG. 1.

DESCRIPTION OF THE PREFERRED EMBODIMENT

Referring to FIGS. 1, 2 and 3, the vibratory roller 1 for compacting base materials generally includes: a main frame means 2; a roller drum carrier 3; a roller drum means 4 mounted on the roller drum carrier 3; a suspension means 6 mounting the roller drum carrier 3 and its roller drums on the frame means 2; a prime mover means 7 mounted on the main frame means; a steering means 8; and an exciter means 9.

The main frame means 2 will now be described. The frame means comprises a front subframe 12 and a rear subframe 11. The front subframe 12 has a front end 16 and an inner end 17. Similarly the rear subframe 11 has a rear end 13 and an inner end 14. As best shown in FIG. 3, the front and rear subframes have their inner ends 14, 17 connected together in facing relation to each other for articulation about a center pivot means 18. The frame means has a longitudinal centerline vertical plane identified by the reference character VP1 in FIG. 3. The center pivot means 18 for connecting the front and rear subframes 12, 11 together lies in the vertical plane VP1.

The prime mover 7 includes an internal combustion engine 21 mounted on rear subframe 11 and is shown in dotted lines in FIG. 2. A hydraulic pump 22 is connected to be driven by internal combustion engine 21 and provides a source of hydraulic pressure for the various hydraulic components of the vibratory roller as will be later described. A hydraulic control console 23 is mounted on the rear subframe 11 and includes a conventional hand operated joystick control 24 for activating the various hydraulic components. The roller vibrator also includes an umbilical cord control system 26 which is releasably connected to the hydraulic control 23 by coupler 27 for remote control of the vibratory roller. The remote hydraulic control system enables the operator to control the operating function of the vibratory roller from a distance. Remote operation can also be provided by using infrared or radio control signals as is known in the art. The prime mover 7 on front subframe 12 is enclosed by a front hood structure 31. The hydraulic control system and associated components on rear subframe 11 is enclosed by a rear hood structure 32 and includes an access door 33 which can be opened to expose the control system 23.

The steering means 8 is best shown in FIGS. 2 and 3 and will now be described. The steering means includes a double-acting hydraulic ram 28 connected between the front and rear subframes 12 and 11 to extend along a line radially offset from the center of pivot axis 18. Expansion and contraction and expansion of the double-acting hydraulic ram 28 will cause articulation of the subframes 11 and 12 relative to each other about pivot means 18.

The frame 2 is supported by the roller drum carrier means 3 which will now be described. The roller drum carrier means comprises front and rear roller drum carriers 37, 36 (FIG. 1) which are of identical construction and best shown in detail in FIGS. 4, 7 and 8. As the roller drum carriers 36, 37 are identical in construction, only the rear roller drum carrier assembly 36 shown in FIGS. 4, 7 and 8 will be described. The roller drum carrier includes a transverse tubular housing 39 having a peripheral wall 41. The peripheral wall includes a center portion 42 and spaced apart outboard ends 43 and 44. The tubular housing has an open interior space and an axle axis AX1. The axle axis AX1 defines an interior upper space 46 which is above the axle axis and an interior lower space 47 which is below the axle axis. The roller drum carrier 36 also includes an exciter support 48 which is located below the axle axis AX1 and between the axle axis and the base material 49 (FIG. 2) on which the vibratory roller sits when it is in a normal operating position. The exciter support 48 includes a mounting pad structure in the lower space below the axle axis centered relative to the vertical plane VP1 passing through the tubular housing 39. The mounting pad structure comprises two mounting ribs 51, one on each side of vertical plane VP1. The mounting ribs 51 have apertures for receiving cap screws 53 to secure exciter means 9, which applies a directional compacting force, to the vibratory roller. The exciter means will be more fully described hereinafter.

The outboard ends 43 and 44 of the tubular housing 39 are closed by means of a closure means 56. As the closure means for each outboard end is identical, only one of the closure means will be described. The closure means includes a circular end plate 57. The inner circumferential periphery of the outboard end 43 of the tubular housing includes a flange 58 provided with a series of circumferentially spaced tapped apertures 54. The peripheral edge of the circular end plate 57 includes a correspondingly spaced series of cap screw receiving apertures 55 and a series of cap screws 59 are threaded through the circular end plate cap screw apertures 55 into the internally tapped apertures 54 of the flange 58 to secure the circular end plate 57 in sealed closing relation with the outboard end 43 of the tubular housing 39. The circular end plate 57 has a central aperture 61 dimensioned to receive an axle mounting hub 62 of the roller drum as will be described hereinafter.

The exciter means 9 for applying a directional compacting force to the vibratory roller is mounted inside of the roller drum carrier on the exciter support 48 as will now be described. The exciter means 9 is best shown in FIGS. 4, 5, 6 and 8. The exciter means 9 includes a housing 64 having a pair of spaced apart end walls 66 and 67. Two counterrotating shafts 69 are mounted in bearings 73 to extend between the end walls 66 and 67 in spaced parallel relation to each other and on opposite sides of vertical plane VP2 passing vertically through axle axis AX1, FIG. 5. Each of the shafts 69 has axially spaced eccentric counterweights 71 mounted thereon. The end 74 of each exciter shaft 69 is provided with a driven gear 76. A hydraulic drive motor 78 is secured to the exciter housing 64 by bolts 79 and includes a power output shaft 81. The power output shaft 81 is connected in driving relation to a drive gear shaft 83 on a drive gear 77 by means of coupling 82. The drive gear 77 mounted on shaft 83 is in driving relation with driven gear 76. The drive gear shaft 83 is journaled in the exciter housing 64 by means of bearings 84. Energization of the exciter hydraulic drive motor 78 will cause drive gear 77 to rotate and cause the exciter shafts 69 to rotate in counterrotating directions, respectively. The phase relationship between the counterrotating eccentric weights 71 on the spaced apart shafts 69 is arranged in known manner, such that the force of the weights will add to each other in a vertical direction to generate a vertical force vector when the vibratory roller is on level terrain. Similarly the horizontal force vector of each of the weights 71 will be counter to the other to counterbalance the forces in the horizontal direction so that the exciter means only provides compacting forces in a vertical direction as is conventional in the art.

In order to mount the exciter means 9 in the roller drive carrier 3, the housing 64 is provided with internally threaded mounting apertures 86, one of which is shown in FIG. 6. The apertures 86 align with corresponding apertures in ribs 51. The exciter means 9 is secured in the lower space 47 on ribs 51 by cap screws 53 (FIG. 4). The exciter means as a unit has a stationary overall center of mass indicated generally at point 88. The exciter unit is mounted to locate this center of mass 88 below the axle axis AX1 to maximize the effectiveness of the weight of the exciter means to lower the overall center of gravity of the vibratory roller.

The roller drum means 4 is mounted on each of the roller drum carriers 3 to support the front and rear subframes 12 and 11 of the vibratory roller. The roller drum means 4 is best shown in FIGS. 4, 7 and 8 and includes a pair of axially aligned spaced apart drums 91 which are mounted on opposite sides of the center portion 42 of each of the tubular housings 39. As shown, the vibratory roller drums have smooth ground engaging surfaces 95 but, if desired, a conventional sheeps foot surfaced drum can be used. As each of the roller drums 91 is identical in construction, only one of the roller drums will be described in detail.

The roller drum 91 includes an internal flange 92 having a central opening 93 for receiving the axle supporting hub 62 which is rotatably supported in bearings 94 carried by the closure means 56 at the outboard ends 43, 44. A drum axle 96 extends through the tubular housing concentric with the axle axis AX1. The roller drum 91 has an inner cylindrical recess 97 dimensioned and configured to overlap and surround the outboard end 43 of the tubular housing 39. The roller drum 91 extends inwardly toward the vertical plane VP1 and terminates adjacent the center portion 42 of the tubular housing 39. The flange 92 of the roller drum 91 is provided with a plurality of cap screw holes 98 and cap screws 99 are inserted through these holes and threaded into corresponding threaded apertures 101 in the axle hub 62. As shown in FIG. 8, two individual roller drums are mounted on each roller drum carrier 3 and therefore it will be understood that drums 91 mounted thereon are axially aligned and spaced apart on opposite sides of the tubular housing center portion 42 when finally assembled.

The vibratory roller suspension means 6 serve to mount the rear roller drum carrier 36 on the rear subframe 11 and the front roller drum carrier 37 on the front subframe 11. The suspension means 6 for the front and rear subframes are identical and therefore only one suspension means will be described.

Referring to FIGS. 2, 3, 5, 7 and 9, each of the suspension means 6 includes outer and inner center mounts 103, 104 secured to outer and inner sides 111, 112 of the center portion 42 of the tubular housing 39 as by welding. With reference to rear subframe 11, the outer mount 103 constitutes a rear mount at the rear end 13 of the vibratory roller. However, when the roller drive carrier 3 is turned 180° and mounted on the front subframe 11, the outer mount 103 constitutes a front mount at the front end 16 of the vibratory roller. As shown in FIG. 3, the outer and inner center mounts 103, 104 extend transversely of the tubular housing 39 and lie in the centerline vertical plane VP1. The outer and inner center mounts 103, 104 are in the form of outer and inner plate members which extend cantilever from the outer and inner sides 111, 112 (FIG. 5) of the roller drum tubular housing. Mud scrapers 116 (FIG. 1) are bolted to the inner mount 104 using apertures 120, best shown in FIGS. 7 and 8. The inner center mount 104 is provided with raceway means 106 opening into the interior of the tubular housing through which hydraulic lines, not shown, may be passed for connection to the exciter and drive units mounted within the roller drum carrier. The outer rear center mount 103 has a single mounting point 107 for connection to the rear end 13 of the frame means and the inner center mount 104 includes two vertically spaced apart mounting points 108, 109 for connection to the front inner end 14 of the rear subframe 11. The suspension means also includes outer U-shaped yoke 113 at rear end 13 and inner vertically spaced inner U-shaped yokes 114, 115 at inner end 14 of rear subframe 11. Each yoke defines a bight portion surrounding the mounting connection points 107, 108, 109 of the rear and front plate members 103, 104. The outer mount connection point 107 is forward of the rear axle axis AX1 and drum 91. The inner mount upper and lower inner connection points 108 and 109 are both forward of the rear axle axis AX1 and rear roller drum 91.

The inner facing ends 14, 17 of the front and rear subframes 12, 11 comprise inner spaced apart vertical plate members 118, 117 secured as by welding to the front and rear subframes, respectively. The vertical inner plates 117, 118 are each braced against fore and aft deflection by gussets 119, 121 which are secured between the vertical inner plate and a horizontal portion of their respective front and rear subframes 12 and 11. The inner U-shaped yokes 114, 115 at the front of rear subframe 11 are secured as by welding to the vertical inner plate 117. The rear yoke 113 is secured to the rear subframe 11 to depend therefrom downwardly with the legs thereof straddling the rear mounting connection 107. A resilient member 122 is secured between the leg members of the outer rear yoke 113 and the center plate. In like manner, the upper and lower inner connections 108, 109 of the inner mount 104 are connected to the upper and lower U-shaped yokes by similar resilient members 122 to provide a resilient centerline suspension of the roller drum carrier assembly 3 on the rear subframe 11. The roller drive carrier assembly 3 for the front subframe is similarly mounted with the front roller drive carrier 3 being rotated 180° to locate outer mount 103 for connection to the front end 16 of the front subframe and the inner mount 104 for connection to the inner end 17 of the front subframe.

As best appears in FIG. 3, the inner center mounts 104 of the front and rear subframes 12, 11 are spaced apart in the longitudinal direction of the vertical plane VP1. The center pivot means 18 includes a vertical pivot axis 126 (FIG. 2) which also lies in vertical plane VP1 and between the spaced apart inner mounts 104. As the outer and inner mounting connections 107, 108, 109 of the front and rear suspension means lie in the vertical plane VP1, they provide a three-point, in-line centerline suspension system for connecting each of the roller drum carriers 3 to its respective subframe. With this suspension system, all of the weight of the vibratory roller subframes 11 and 12 and the components thereon are concentrated in the centerline vertical plane VP1 to maximize weight at the centerline of the vibratory roller and thus enhance the lateral stability of the vibratory roller. By concentrating the weight of the vibratory roller at the centerline vertical plane VP1, the tendency of such subframe weight to produce tipping of the vibratory roller is minimized.

The vibratory roller is propelled by power supplied by the prime mover 7 through hydraulically driven motor drive units 127, 128 mounted within each of the roller drum carriers 3. Referring to FIG. 4, the two motor drive units are mounted within the tubular housing 39 of the roller drum carrier. The motor drum units 127, 128 are in upper space 46 and on opposite sides of the vertical plane VP1, FIG. 4. As each hydraulic motor drive unit and the power train connecting it to its respective roller drum 91 is identical, only one of the motor drive units will be described.

With reference to FIG. 4, the hydraulic motor drive unit 127 includes a motor drive housing 129 which is secured by cap screws 131 to the inner side of the cylindrical plate 57 of the closure means 56. The drive housing 129 surrounds a driven gear 132 which is nonrotatably secured to axle hub 62. The hydraulic drive motor unit 127 also includes drive shaft 134 having a pinnion gear 133 thereon which is in mesh with driven gear 132. Energization of the hydraulic motor 127 drives pinnion gear 133 to rotate driven gear 132 and drive the associated roller drum 91. As shown in FIGS. 4 and 5, the hydraulic motor drive units are mounted inside the tubular housing 39 of the rotor drum carrier 3 in the upper space 46 above the axle axis AX1. By placing the motor drive units 127, 128 in the tubular housing 39, the weight thereof is also more effectively located to lower the overall center of gravity of the vibratory roller.

The roller vibratory thus constructed locates the exciter means 9 on an exciter support 48 which is below the axle axis AX1 of the roller drum carrier 3 to lower the overall center of gravity of the roller vibrator to as close as possible to the base material when the roller vibrator is in the normal operating position. In addition, the two hydraulic motor drive units 127 and 128 are also mounted in the roller drum carrier tubular housing 39 in the upper space 46 above the axle axis AX1 to further increase the total weight of components located as close as possible to the base material 49 to further lower the overall center of gravity of the roller vibrator and bring it as close as possible to the base material.

The preferred embodiment above described is by way of example and modifications thereof will be apparent to those skilled in the art without departing from the inventive concept claimed herein.

What is claimed is:

1. A vibratory roller for compacting base materials comprising:

a frame means having a longitudinal centerline vertical plane and front and rear ends;

a roller drum carrier including an axle axis and an exciter support located below said axle axis between said axle axis and said base material when said vibratory roller is in a normal operating position;

a suspension means mounting said roller drum carrier on said frame means;

a roller drum means including an axle mounted on said roller drum carrier for rotation about said axle axis;

a prime mover means operatively mounted to rotate said roller drum means and to move said vibratory roller;

a steering means for controlling the direction of movement of said vibratory roller; and an exciter means for applying a directional compacting force to said roller drum and having a stationary center of mass, said exciter means mounted on said exciter support to place said exciter center of mass below said axle axis to locate the center of gravity of said roller vibrator as close as possible to said base material when in a normal operating position.

2. The vibrator roller according to claim 1 wherein said roller drum carrier includes a tubular housing having a peripheral wall presenting a center portion, outboard ends, an interior lower space below said axle axis and an interior upper space above said axle axis with said exciter support being in said lower space.

3. A vibratory roller according to claim 1 wherein said exciter means includes two counterrotating spaced parallel shafts each having an eccentric counterweight thereon;

said counterrotating shafts extending in spaced parallel relation to said axle axis; and said two counterrotating shafts and their respective eccentric counterweights being on opposite sides of a vertical plane passing parallel through said axle axis of said roller drum carrier.

4. A vibratory roller according to claim 1 wherein said main frame includes a front subframe having a front end and an inner end and a rear subframe having a rear end and an inner end;

a center pivot means is provided for connecting said inner ends of said subframes together in facing relation for articulation relative to each other;

said steering means is mounted to cause said subframes to articulate relative to each other to a selectable degree to steer said roller vibrator;

said roller drum carrier comprises individual front and rear roller drum carriers mounted on said front and rear subframes, respectively, by said suspension means;

said roller drum means is mounted on each of said roller drive carriers; and said exciter means is mounted in at least one of said roller drum carriers.

5. The vibrator roller according to claim 2 wherein said suspension means includes outer and inner center mounts on said center portion of said tubular housing, said outer and inner mounts lying in said vertical plane and extending transversely of said tubular housing toward said front and rear ends of said frame means; and said exciter support includes a mounting pad inside of said tubular housing in said lower space below said axle with said exciter means being mounted on said mounting pad.

6. The vibrator roller according to claim 5 wherein said mounting pad is centered on said center portion of said tubular housing.

7. The vibratory roller according to claim 5 wherein said tubular housing interior lower space extends on opposite sides of said center portion;

said exciter means is mounted in said lower space of said tubular housing to place said center of mass thereof below said axle axis and substantially centered on said vertical plane; and said roller drum means includes a pair of axially aligned spaced apart drums on opposite sides of said center portion each having an inner recess, said inner recesses facing each other and surrounding said outboard ends of said tubular housing, said drums extending to said front and rear center mounts with said axle extending through said tubular housing concentric with said axle axis.

8. The vibratory roller according to claim 5 wherein said outer center mount includes a single mounting connection to said front end of said frame means and said inner center mount includes two vertically spaced apart mounting connections to said frame.

9. The vibratory roller according to claim 5 wherein said frame includes outer and inner U-shaped yokes lying in said vertical plane for connection with said outer and inner center mounts, respectively.

10. The vibratory roller according to claim 2 wherein said primer mover means includes a motor drive unit mounted inside of said tubular housing in said upper space above said axle axis.

11. The vibratory roller according to claim 8 wherein said motor drive unit comprises two motor drive units, said motor drive units being on opposite sides of a vertical plane passing parallel through said center portion.

12. The vibratory roller according to claim 2 wherein a closure means is mounted in said tubular housing to close each of said outboard ends;

said axle is journaled in said closure means; and said prime mover includes a motor means mounted in said upper space of said tubular housing and operatively connected to drive said roller drum means.

13. A vibratory roller for compacting base materials comprising:

a frame means having a longitudinal centerline vertical plane, a front subframe having a front end and an inner end, and a rear subframe having a rear end and an inner end;

a center pivot means connecting said inner ends of said subframes together in facing relation for articulation relative to each other;

steering means for causing said subframes to articulate about said center pivot to a selectable degree to steer said roller vibrator;

front and rear roller drum carriers having front and rear axle axes, respectively, extending transversely to said vertical plane;

a suspension means for mounting said front and rear roller drum carriers on said front and rear subframes, respectively, said suspension means including outer and inner mounts on each of said roller drum carriers lying in said vertical plane, said inner mounts each including an upper and a lower inner connection to said inner ends of said subframes lying in said vertical plane, and said outer mounts including front and rear connections with said front and rear ends of said subframes lying in said vertical plane;

a roller drum means mounted on each of said roller drum carriers for rotation about said respective axle axis;

a prime mover mounted on said roller vibrator to rotate said roller drum means to move said roller vibrator; and an exciter means mounted on said vibratory roller for applying a directional compacting force to at least one of said roller drums at least one of said roller drum carriers includes a lower exciter support located below said axle axis and between said axle axis and said base material when said vibratory roller is in a normal operating position; and said exciter means has a stationary center of mass, said exciter means mounted on said lower exciter support to place said exciter center of mass below axle axis to locate the center of gravity of said roller vibrator as close as possible to said base material when in a normal operating position.

14. The vibratory roller according to claim 13 wherein said outer mount front connection between said front roller drum carrier and said front end of said front subframe is forward of said front axle axis and said inner mount upper and lower inner connections between said front roller drum carrier and said inner end of said front subframe are rearward of said front axle axis; and said outer mount rear connection between said rear roller drum carrier said rear end of said rear subframe is rearward of said rear axle axis and said inner mount upper and lower inner connections between said rear roller drum carrier and said inner end of said rear subframe are forward of said rear axle axis.

15. The vibratory roller according to claim 13 wherein said inner mounts of said front and rear subframes are spaced apart in the direction of the longitudinal extent of said vertical plane;

said center pivot means includes a vertical pivot axis lying in said vertical plane between said spaced apart inner mounts; and said front and rear connections each comprise a single connection with said front and rear subframes, respectively, to provide a three-point centerline connection for each of said roller drum carriers to its respective subframe.

16. The vibratory roller according to claim 13 wherein said inner and outer mounts of said front and rear subframes include inner and outer plate members extending cantilever from said roller drum carrier and lying in said vertical plane;

said upper and lower inner connections and said front and rear connections each includes a U-shaped yoke defining a bight portion surrounding said plate members; and a resilient member interconnects each of said yokes to its respective plate member.

17. The vibratory roller according to claim 13 wherein said roller drum carrier includes a tubular housing having a peripheral wall defining an interior lower space below said axle axis and an interior upper space above said axle axis;

said roller drum means including a pair of axially aligned spaced apart drums on opposite sides of said center plane and rotatably mounted on said roller drum carrier;

said lower exciter support includes a mounting pad inside of said tubular housing in said lower space below said axle axis with said exciter means being mounted on said mounting pad to place said center of mass in said vertical plane; and said primer mover includes two motor drive units mounted inside of said tubular housing in said upper space above said axle axis, said drive units being on opposite sides of said vertical plane with one of said drive units connected to drive one of said drums and the other drive unit connected to drive the other of said drums.

* * * * *

US005082396C1

(12) EX PARTE REEXAMINATION CERTIFICATE (8038th)

United States Patent
Polacek

(10) Number: US 5,082,396 C1
(45) Certificate Issued: Feb. 22, 2011

(54) VIBRATORY ROLLER

(75) Inventor: Manfred Polacek, Munich (DE)

(73) Assignee: Wacker Neuson Corporation, Menomonee Falls, WI (US)

Reexamination Request:
No. 90/010,727, Nov. 2, 2009

Reexamination Certificate for:

| | |
|---|---|
| Patent No.: | **5,082,396** |
| Issued: | **Jan. 21, 1992** |
| Appl. No.: | **07/602,669** |
| Filed: | **Oct. 24, 1990** |

(30) Foreign Application Priority Data

Dec. 8, 1989 (DE) ..... 3940653

(51) Int. Cl.
*E01C 19/38* (2006.01)
*E01C 19/26* (2006.01)

(52) U.S. Cl. ..... 404/117; 404/102; 404/127
(58) Field of Classification Search ..... 404/102, 404/117, 127
See application file for complete search history.

(56) References Cited

U.S. PATENT DOCUMENTS 3,486,427 A * 12/1969 Waschulewski et al. ..... 404/117
4,927,289 A * 5/1990 Artzberger ..... 404/117

FOREIGN PATENT DOCUMENTS

DE 1212004 * 3/1966

* cited by examiner

*Primary Examiner*—Jimmy G Foster

(57) ABSTRACT

A vibratory roller is disclosed having a fram comprised of pivotally interconnected front and rear subframes. A motor is mounted on the frame and a steering mechanism is provided to articulate the subframe relative to each other. A roller drum carrier is mounted by a longitudinal centerline suspension system to support each of the subframes. Ground engaging roller drums are rotatably mounted on the roller drum carrier for rotation about an axle axis. An exciter mechanism for generating a vibratory compacting force is mounted in the roller drum carrier below the axis. Hydraulic drive units for rotating the roller drums are mounted in the roller drive carrier above the axis.

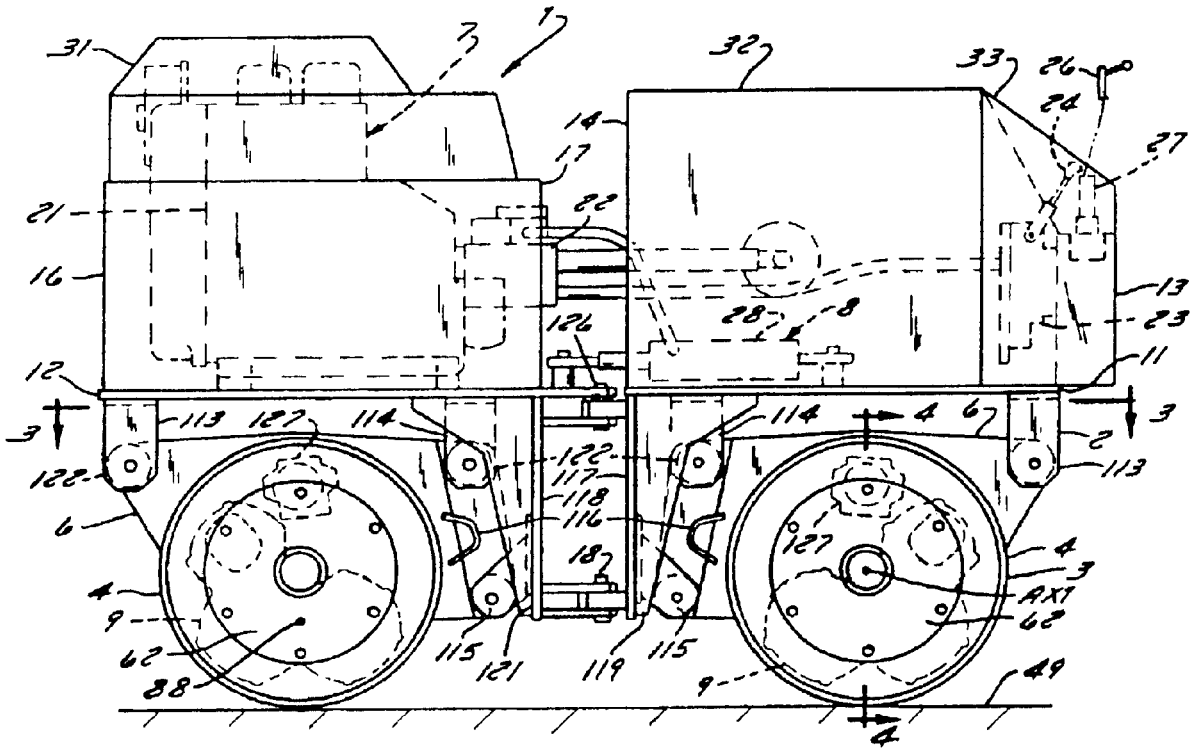

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 2, 3 and 5-17 is confirmed. Claims 1 and 4 are cancelled.

* * * * *